United States Patent [19]

Käufeler

[11] Patent Number: 4,750,615

[45] Date of Patent: Jun. 14, 1988

[54] APPARATUS TO MAINTAIN SEPARATE UNTIL THE MOMENT OF USE, TWO DIFFERENT SUBSTANCES WITHIN A CONTAINER, PARTICULARLY TWO-COMPONENT RESINS

[75] Inventor: Max Käufeler, Cadempino, Switzerland

[73] Assignee: Intecser S.A., Cadempino, Switzerland

[21] Appl. No.: 881,048

[22] Filed: Jul. 1, 1986

[30] Foreign Application Priority Data

May 6, 1986 [CH] Switzerland ..... 01845/86

[51] Int. Cl.[4] ..... B65D 25/08

[52] U.S. Cl. ..... 206/222; 366/256; 206/568

[58] Field of Search ..... 206/219, 220, 221, 222, 206/568, 569; 366/129, 130, 255, 256, 333; 215/DIG. 8

[56] References Cited

U.S. PATENT DOCUMENTS

| | | | |
|---|---|---|---|
| 1,897,723 | 2/1933 | Free | 206/222 |
| 2,788,002 | 4/1957 | Hinson et al. | 206/222 |
| 2,954,144 | 9/1960 | Elam et al. | 206/222 |
| 3,023,587 | 3/1962 | Robbins | 206/219 |
| 3,140,078 | 7/1964 | Krahe et al. | 366/256 |
| 3,655,096 | 4/1972 | Easter | 206/222 |
| 3,713,780 | 1/1973 | Shapiro | 206/222 |
| 3,741,383 | 6/1973 | Wittwer | 206/219 |
| 3,756,389 | 9/1973 | Firth . | |
| 4,007,831 | 2/1977 | Bernhardt . | |
| 4,057,047 | 11/1977 | Gossett | 206/219 |
| 4,065,107 | 12/1977 | Van Horbek | 366/129 |
| 4,153,156 | 5/1979 | Seemann et al. . | |
| 4,182,447 | 1/1980 | Kay . | |
| 4,208,133 | 6/1980 | Korte-Jungerman | 366/130 |
| 4,211,019 | 7/1980 | McCafferty . | |
| 4,239,105 | 12/1980 | Gilbert . | |
| 4,253,566 | 3/1981 | Seemann . | |
| 4,265,216 | 5/1981 | Marshall et al. . | |
| 4,291,799 | 9/1981 | Bower, Jr. . | |
| 4,343,399 | 8/1982 | Patel et al. . | |
| 4,353,463 | 10/1982 | Seemann . | |
| 4,496,046 | 1/1985 | Stone et al. . | |
| 4,509,641 | 4/1985 | Scieri et al. . | |
| 4,519,499 | 5/1985 | Stone et al. . | |
| 4,534,509 | 8/1985 | Holzner . | |

FOREIGN PATENT DOCUMENTS

| | | | |
|---|---|---|---|
| 1180265 | 12/1962 | Fed. Rep. of Germany | 206/219 |
| 2828027 | 1/1980 | Fed. Rep. of Germany | 206/219 |
| 2345363 | 10/1977 | France | 206/220 |
| 2447875 | 10/1980 | France | 206/222 |
| WO81/00549 | 3/1981 | World Int. Prop. O. . | |
| 1345243 | 1/1974 | United Kingdom . | |
| 2104863 | 3/1983 | United Kingdom . | |
| 2134067 | 8/1984 | United Kingdom . | |

*Primary Examiner*—Joseph Man-Fu Moy

*Attorney, Agent, or Firm*—Young & Thompson

[57] ABSTRACT

The apparatus comprises a container (1) with rigid or flexible walls containing one or two resin components and a container (26) of thin glass or fragile synthetic resin containing the other component. Container (26) at the moment of use is broken either by manually compressing container (1) or inserting a rod (5) provided with handle (11) through guide piston (39) and through the container (26) until reaching disk (27) to which the rod is screwed or fastened by flexible teeth, which disk serves as a mixing piston to mix the two components, prior to distributing them from an outlet (2).

2 Claims, 1 Drawing Sheet

APPARATUS TO MAINTAIN SEPARATE UNTIL THE MOMENT OF USE, TWO DIFFERENT SUBSTANCES WITHIN A CONTAINER, PARTICULARLY TWO-COMPONENT RESINS

This invention relates to an apparatus to maintain separate until the movement of use, within a cartridge, container, tube or the like, two different substances that are liquid, paste or solid, in powder or granular form, and particularly two-component resins, to mix them at the moment of use and to distribute them.

The apparatus comprises in a way known from previous patent application No. 5 189/85-1, filed on Dec. 6, 1986 by the same applicant, a container that is spherical, cylindrical or in any other shape, having easily tearable or breakable walls, containing one of the two substances or components to be mixed, while the other substance or component placed in the container is outside said tearable or breakable container. Means are provided to tear or break said container while a piston or the like makes it possible to mix the two components at the moment of use and to distribute them mixed from the output opening of the container.

The apparatus under discussion is characterized in that said means for tearing and breaking said container consist of a threaded rod or rod provided with flexible teeth and preferably pointed at its front end and provided with a handle, at its back end, a rod axially introducible in the cartridge, container or the like perforating the diaphragm or the cap that closes said container, a rod guided by a guide piston that can slide in said cartridge, container, tube or the like, breaking said container, if necessary, and screwing on the threading or inserting its teeth into complementary recesses of a stirring disk or the like that serves for mixing the two components.

According to a preferred embodiment, said container is made of glass or fragile synthetic material and is free or bound, i.e., supported by said guide piston, while the parts of the cartridge, container or the like are of a flexible material so that breaking of the container can also be performed by manually or mechanically compressing said flexible cartridge.

For greater clarity, the accompanying drawings represent some preferred nonlimiting and nonbinding embodiments of the apparatus under discussion.

FIGS. 1, 2, 3 relate to a first embodiment;

FIG. 4 relates to a second embodiment;

FIG. 5 relates to a third embodiment;

Figure 1:
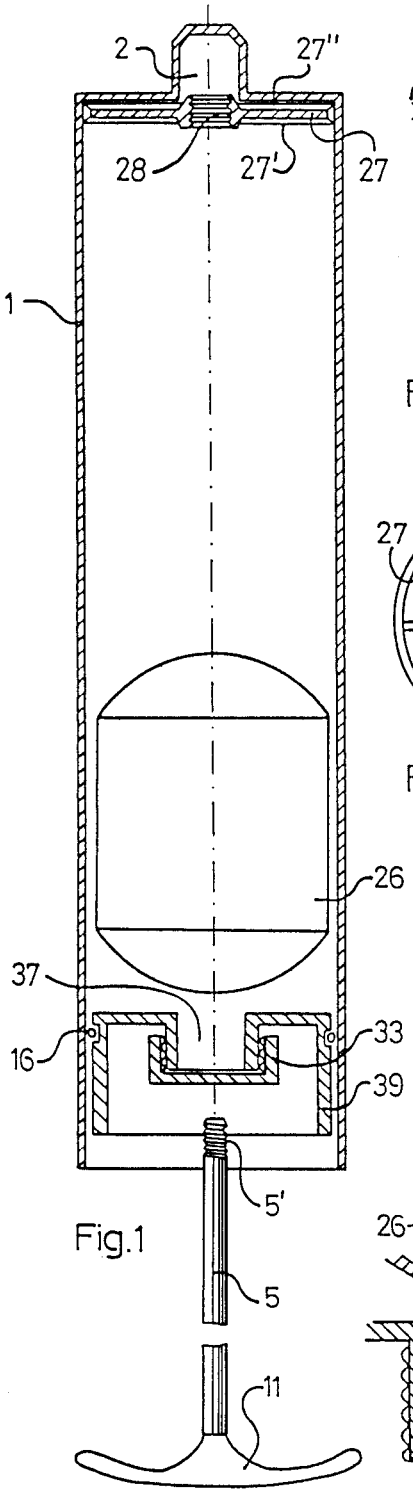
Figure 2:
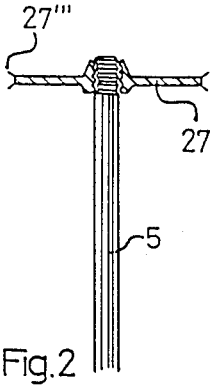
Figure 3:
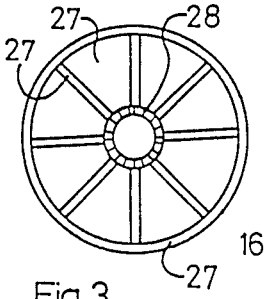

With reference to FIGS. 1, 2, 3, the apparatus comprises cartridge, container, tube or the like 1 preferably of rigid or flexible resins, or aluminum, inside of which is placed container (26) of glass or fragile synthetic resin, so that its walls can be easily broken either by manually or mechanically compressing the walls of cartridge 1, or by running rod (5) through hole (37) or diaphragm (33) of piston (39), and causing container (26) to be passed through by said rod, breaking it.

Container (26) contains, for example, one of the components of the two-component resin, while the outside of container (26) is occupied by the other component.

With container (26) being broken at the moment of use, the two resin components are mixed and distributed through opening (2).

Rod (5), provided with handle (11), is preferably pointed and threaded at its front end (5'), so that at the end of travel it can be screwed into threading (28) of disk (27).

At the end of rod (5) there can be, as a substitute for the threading (5), three or four fine, flexible circular teeth which are deformed when rod (5) is thrust into or removed from threading (28) of disk (27) or complementary recesses.

The teeth are supposed only to resist the agitation force (the resistance is less than that of machine grease) and should be deformed by a jerk of the hand.

This disk can act as a piston to mix the two components, especially when they are not fluid, i.e., are gelatinous or pasty.

When they are fluid, the agitation can occur simply by shaking cartridge (1), and disk (27) can then be omitted.

The disk (27) is provided with reinforcing fins 27' and 27'' (FIGS. 1 and 3) and holding lips 27''' as shown in FIG. 2, or simply provided with numerous holes, or screened. Underlying piston (39) to which perforable cap (33) is screwed, in this case acts as a guide for rod (5).

Rod (5) can be provided at end (5') with deformable blades or capillaries either to facilitate introduction and extraction of piston (39) through the hole or to obtain a forced agitation.

Figure 4:
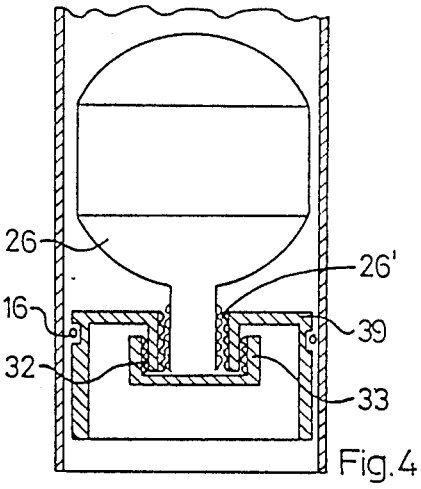

In the second embodiment shown in FIG. 4, container (26) is provided with an externally threaded neck (26') which is screwed into the complementary threading of the coaxial hole of piston (39).

In this case, piston (39) acts as a support for container (26), and cap (33), perforable by rod 5, closes the opening of container (26).

Figure 5:
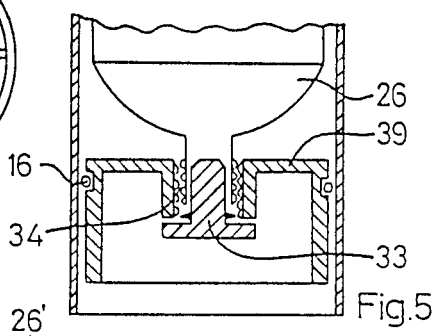
Figure 6:
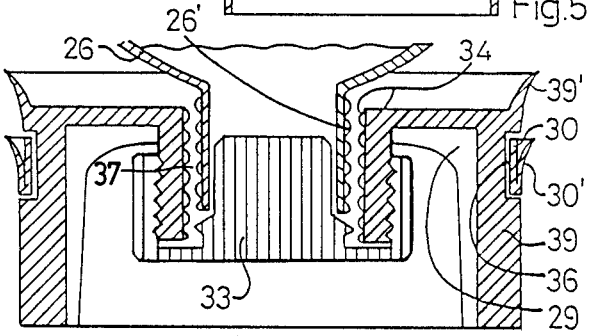
FIG. 6 represents on a larger scale a variant of the third embodiment shown in FIG. 5.

FIG. 5 shows a third embodiment, similar to the preceding one, but with cap (33) in a different shape, which can be seen better in FIG. 6.

In this case, piston (39) is provided, for perfect sealing, with a flexible widening (39') and a V gasket (30), (30') replacing a normal O ring.

Figure 7:
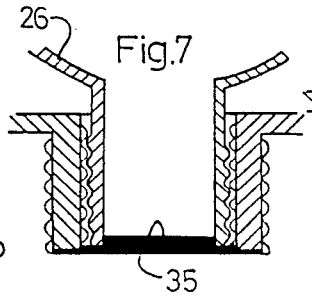
FIGS. 7 and 8 are some variants relating to the second embodiment in FIG. 4.
Figure 8:
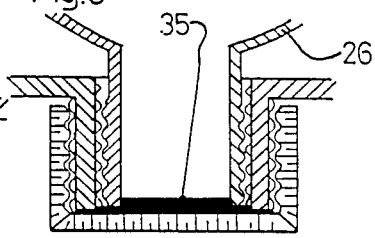

In FIGS. 7 and 8 is provided a perforable diaphragm (35) which closes the opening of the neck of container (26) when cap (33) is put in place.

Other variants are possible, in a manner compatible with what has been claimed, without going outside the scope of protection of the invention.

I claim:

1. Apparatus for maintaining separate two different components within a container and for mixing them immediately prior to use, comprising an outer container containing one of the components, and a readily rupturable inner container within the outer container and containing the other of the components, a stirrer disposed within the outer container, and a rod insertable through the outer container, then in the same direction through the inner container, and by further movement in said same direction into contact with the stirrer, the rod and stirrer having interengageable means thereon for connecting the stirrer to the end of the rod within the outer container, whereby the rod can thereafter move the stirrer within the outer container to mix the components.

2. Apparatus as claimed in claim 1, said rod being insertable through a wall of said outer container comprising a piston slidable in the outer container to serve as a discharge assistant for mixed material emerging from an outlet opening in said outer container opposite said piston.

* * * * *